US007974562B2

(12) United States Patent
Okuno et al.

(10) Patent No.: US 7,974,562 B2
(45) Date of Patent: Jul. 5, 2011

(54) FIXING DEVICE AND IMAGE FORMING APPARATUS

(75) Inventors: Jinju Okuno, Toyohashi (JP); Kazunori Nishinoue, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 388 days.

(21) Appl. No.: 12/195,226

(22) Filed: Aug. 20, 2008

(65) Prior Publication Data

US 2009/0052958 A1 Feb. 26, 2009

(30) Foreign Application Priority Data

Aug. 21, 2007 (JP) ..... 2007-214431

(51) Int. Cl.
*G03G 15/20* (2006.01)

(52) U.S. Cl. ..... 399/329

(58) Field of Classification Search ..... 399/122, 399/320, 328, 329, 333
See application file for complete search history.

(56) References Cited

U.S. PATENT DOCUMENTS

2006/0216077 A1* 9/2006 Komuro ..... 399/328
2007/0059012 A1* 3/2007 Tomine et al. ..... 399/69

FOREIGN PATENT DOCUMENTS

| | | |
|---|---|---|
| JP | 2002-148985 | 5/2002 |
| JP | 2002-372881 | 12/2002 |
| JP | 2005-003781 | 1/2005 |
| JP | 2005-077872 | 3/2005 |
| JP | 2005-148618 | 6/2005 |
| JP | 2005-331576 | 12/2005 |
| JP | 2006-313256 | 11/2006 |
| JP | 2007-79183 | 3/2007 |

OTHER PUBLICATIONS

Japanese Preliminary Notice of Rejection dated Mar. 16, 2010, directed towards corresponding JP Application No. 2007-214431; 6 pages.
Japanese Office Action mailed Aug. 4, 2009, directed toward Japanese Patent Application No. 2007-214431; 6 pages.

* cited by examiner

*Primary Examiner* — David M Gray
*Assistant Examiner* — Barnabas T Fekete
(74) *Attorney, Agent, or Firm* — Morrison & Foerster LLP

(57) ABSTRACT

An image forming apparatus includes a fixing device in which a width of a slide member is larger than a width of a pressurizing belt while both ends of the slide member are positioned outside of both ends of the pressurizing belt. The above-structured slide member makes it possible to prevent lubricant on the slide member from leaking out of the ends of the slide member and coming around the inner surface of the slide member, and thereby to prevent a pressing member beneath the slide member from swelling, resulting in avoidance of wrinkle generation on recording materials.

10 Claims, 8 Drawing Sheets

FIXING DEVICE AND IMAGE FORMING APPARATUS

CROSS-REFERENCE TO RELATED APPLICATION

This application is based on application No. 2007-214431 filed in Japan, the entire content of which is hereby incorporated by reference.

BACKGROUND OF THE INVENTION

The present invention relates to a fixing device for use in, for example, copying machines, laser printers and facsimiles and to an image forming apparatus using the fixing device.

Image forming apparatuses such as an electrophotographic color printer or a color copying machine are mounted with fixing devices. Among fixing devices, a fixing device shown in FIG. 7 has been known as one having small heat capacity in order to accomplish reduction in temperature rising time. The fixing device generally includes a heating roller 101, a pressurizing belt 102 in contact with the heating roller 101, and a pressing member 103 placed inside of the pressurizing belt 102 to press an inner (rear) surface of the pressurizing belt 102 toward the heating roller 101.

The pressing member 103, which is constituted of elastic materials such as silicone rubber, has a function to stretch the pressurizing belt 102 over the heating roller 101.

To reduce the sliding resistance of the pressurizing belt 102, it is commonly used to insert a slide member 104 between the pressing member 103 and the pressurizing belt 102, and to interpose an oil between the inner surface of the pressurizing belt 102 and the sliding surface of the slide member 104, wherein the oil is fed from an oil application felt 106.

The oil accumulates in an inlet N1 of a contact section in which the slide member 104 is brought into a pressure contact with the inner surface of the pressurizing belt 102. The contact section is formed along with formation of a nip section which is formed by the contact between the heating roller 101 and the pressurizing belt 102. This oil accumulation is caused by such a high pressure that the oil fails to enter into the nip formed between the slide member 104 and the pressurizing belt 102.

As shown in FIG. 8, the oil, which fails to enter into the contact section between the slide member 104 and the pressurizing belt 102 and accumulated in the inlet section N1, is pushed out in the direction of an arrow "A" toward both end sections of the slide member 104. The oil is pushed out over both the end sections of the slide member 104. Thereby, the oil is attached to the pressurizing belt 102 and transported in the state of being attached to the pressurizing belt 102. Then, the oil comes around an inner surface of the slide member 104 due to being blocked by an edge section 103*a* of the pressing member 103.

The oil, which has come around the inner surface of the slide member 104, swells the pressing member 103. This causes a change of pressure in the nip section away from desired pressure so that wrinkles are generated on paper when the paper passes through the nip section.

Moreover, torque of the device is increased due to shortage of oil since the oil flows out onto the inner surface of the slide member 104. Consequently, lifetime of the device is shortened.

Conventionally, in order to prevent oil leakage out of both end sections of the contact section, JP 2005-77872A has proposed that an oil-central-collecting member is placed downstream of the contact section in such a way as to come into contact with an inner surface of the pressurizing belt.

However, the collecting member does not directly regulate oil leakage in the inlet section. Besides, the oil centrally collected by the collecting member is leveled by being rubbed against an oil coating member. Therefore, the collecting member has little effect on the prevention of oil leakage at both the ends of the inlet section.

JP 2002-372881A has proposed that oil is applied to a central portion only. This has some effect of suppressing the amount of oil overflowed to outside from the ends of the slide member, but no effect on oil leakage which has overflowed to the outside and come around the inner surface of the slide member.

JP 2005-3781A has also proposed that extrusions and indentions are spirally provided on an inner surface of belt so that oil is guided to the inside direction to prevent oil leakage when the belt rubs against a slide member. However, the belt is weak in binding force on oil, particularly in the inlet section. Therefore, this proposal has small effect on suppressing oil leakage to the outside of the ends of the slide member.

In any of the above-mentioned conventional devices, it is impossible to expect to functionally prevent the oil from leaking to the outside over ends of the slide member, from coming around the inner surface of the slide member and from swelling the pressing member.

BRIEF SUMMARY OF THE INVENTION

Accordingly, an object of the present invention is to provide a fixing device which keeps oil as a lubricant from leaking out of both end sections of a slide member and coming around the inner surface of the slide member to prevent the oil from coming into contact with a pressing member and to prevent swelling of the pressing member by the oil, and to provide an image forming apparatus using the fixing device.

In order to achieve the above-mentioned object, one aspect of the present invention provides a fixing device which has a pair of rotation units rotating together in a state of contacting with each other, a pressing member placed inside one rotation unit out of the pair of rotation units and pressing an inner surface of the one rotation unit toward other rotation unit out of the pair of rotation units, a slide member placed between the one rotation unit and the pressing member and sliding on the inner surface of the one rotation unit in rotation, and a lubricant feed section feeding a lubricant to the inner surface of the one rotation unit, wherein a width of the slide member is larger than a width of the one rotation unit in a direction parallel to an axis of the one rotation unit, and wherein both end sections of the slide member are positioned outside of both end sections of the one rotation unit in the direction parallel to the axis of the one rotation unit.

According to this fixing device, the width of the slide member is larger than the width of the one rotation unit, and both the end sections of the slide member are positioned outside of both the end sections of the one rotation unit, in the direction parallel to the axis of the one rotation unit. Thereby, margins are formed in the end sections of the slide member. Even when the lubricant between the slide member and the one rotation unit moves in the axial direction of the one rotation unit, the lubricant does not reach the ends of the slide member due to the margins. As the result, the lubricant will not come around the inner surface of the slide member.

Thus, the lubricant does not come into contact with the pressing member placed beneath on the inner surface of the slide member. This prevents swelling of the pressing member caused by the lubricant, and prevents generation of wrinkles on recording materials held between the pair of rotation units.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Hereinbelow, embodiments of the present invention will be described in details with reference to the drawings by way of illustration.

First Embodiment

Figure 1:
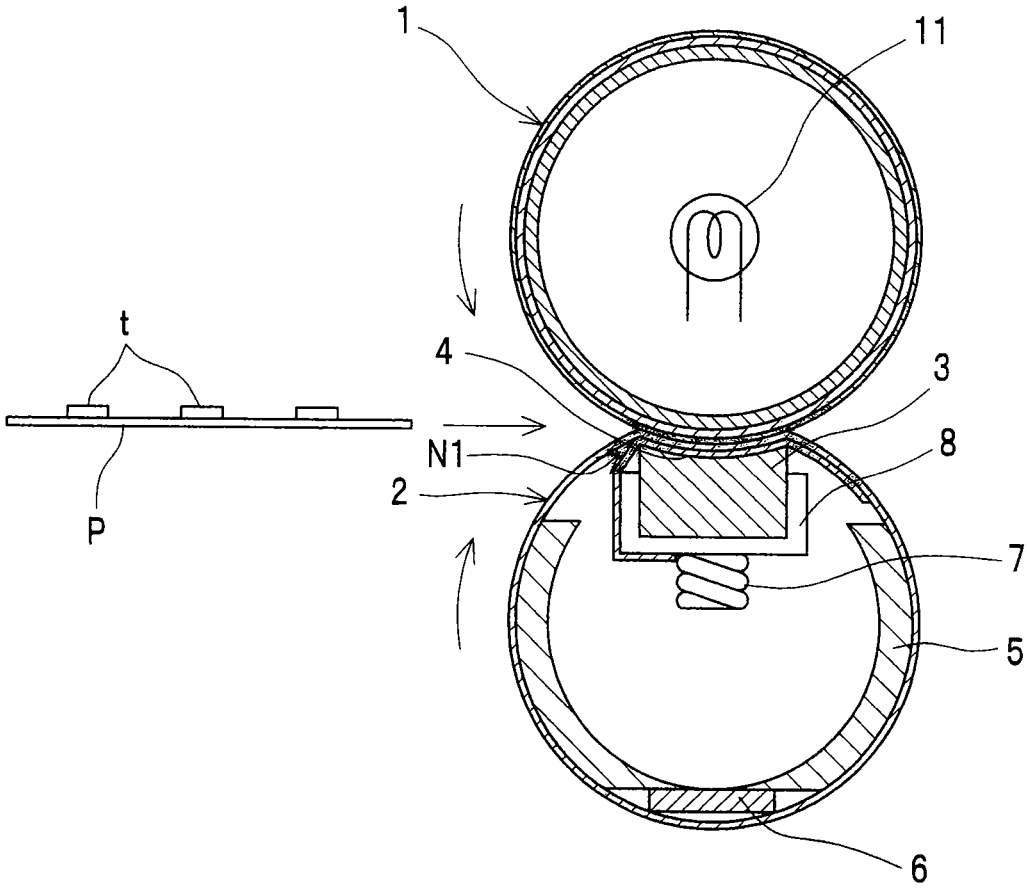
FIG. 1 shows a simplified schematic view of a fixing device according to a first embodiment.

A fixing device according to a first embodiment has a heating roller 1, a pressurizing belt 2, a pressing member 3, a slide member 4 and a lubricant feed section 6, as shown in FIG. 1. The heating roller 1 and the pressurizing belt 2, as a pair of rotation units, rotate together with their peripheral faces being in contact with each other. The pressing member 3 is placed inside the pressurizing belt 2 for pressing an inner surface of the pressurizing belt 2 toward the heating roller 1. The slide member 4 is placed between the pressurizing belt 2 and the pressing member 3 and is made to slide on the inner surface of the rotating pressurizing belt 2. The lubricant feed section 6 feeds a lubricant to the inner surface of the pressurizing belt 2.

The heating roller 1 is rotated by a driving section (unshown) such as a motor. The pressurizing belt 2 rotates around a given rotational center following after the rotation of the heating roller 1 due to the friction with the heating roller 1. A direction in which the center extends i.e. a width direction of the belt 2 is referred to as an axial direction. The heating roller 1 is heated by a heating heater 11 placed inside thereof. The heat is transmitted to the pressurizing belt 2 from the heating roller 1.

The heating roller 1 and the pressurizing belt 2 transport a recording material P in the state of contacting with each other so as to simultaneously fix toner t on the recording material P to the recording material P. Specifically, a nip section is formed by the contact between the heating roller 1 and the pressurizing belt 2, so that the nip section transports the recording material P while melting the toner t on the recording material P and simultaneously fixing the toner t to the recording material P. Pressing through elastic deformation of the pressing member 3 makes it possible to more successfully fix the toner t to the recording material P.

The recording material P is sheets such as paper sheets and OHP sheets. The toner "t" is adhered to one surface of the recording material P. The toner t is made of materials having thermal meltability such as resins, magnetic substances and colorants.

The heating roller 1 comes into contact with an image surface of the recording material P. The heating roller 1 is hollow and has an inner layer, an elastic layer and an outer layer in order from inside to outside. The outside diameter of the heating roller 1 is 26 mm, for example. The inner layer is made of 2-mm-thick aluminum, for example. The elastic layer is made of 200-micrometer-thick silicone rubber, for example. The outer layer is made of a 20-micrometer-thick PFA tube, for example.

The pressurizing belt 2 is an endless belt and has an outside diameter of 30 mm, for example and is made of 70-micrometer-thick polyimide, for example.

A supporter (not shown) is provided in the pressurizing belt 2. A pedestal 8 is attached to the supporter through a compression spring 7. The pressing member 3 is fixed to the pedestal 8. The pressing member 3 is a pad made of silicone rubber, for example.

The slide member 4 has a sheet-like shape, and is fixed to the pedestal 8 to cover the pressing member 3. Specifically, one end of the slide member 4 is fixed to the pedestal 8 while the other end thereof is a free end, wherein the one end of the slide member 4 is located upstream from the pressing member 3 in a rotation direction of the pressurizing belt 2 while the other end of the slide member 4 is located downstream from the pressing member 3 in the rotation direction of the pressurizing belt 2.

A pair of support members 5 are respectively attached to both axial ends of the pressurizing belt 2, so that the support members 5 supports the pressurizing belt 2 from the inner surface thereof. Each of support members 5 has a shape of the letter "C", when viewed from the axial direction of the pressurizing belt 2 in FIG. 1.

The lubricant feed section 6 applies the lubricant to the inner surface of the pressurizing belt 2 so as to secure the lubricity between the pressurizing belt 2 and the slide member 4. The lubricant feed section 6 is an oil application felt, for example. The lubricant is silicone oil, for example. The viscosity of the lubricant has 200 to 400 centistokes (abbreviated as "cs").

Figure 2:
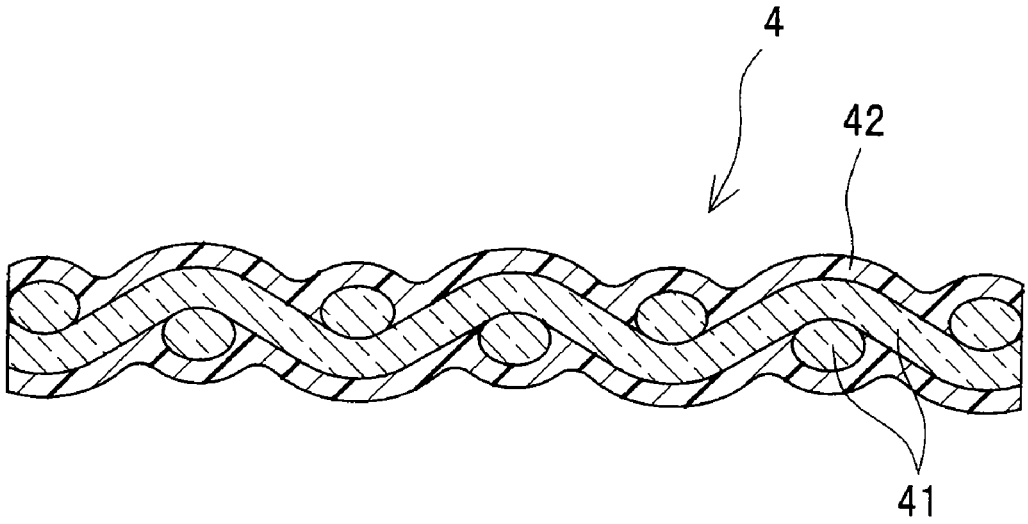
FIG. 2 shows a cross-sectional view of a slide member.

As shown in FIG. 2, the slide member 4 has a glass cloth 41 and a heat-resistant resin 42. The glass cloth 41 is used as a base material, and the glass cloth 41 is covered with the heat-resistant resin 42. If a sliding surface of the slide member 4 is flat and smooth, the lubricant in the region of the nip section i.e. in the contact section between the slide member 4 and the pressurizing belt 2 is pushed out by pressure. As the result, a layer of the lubricant is not sufficiently formed on the sliding surface of the slide member 4. Accordingly, the glass cloth 41 having uneven surfaces is impregnated with PTFE (polytetrafluoroethylene) for heat-resistant resin 42 and calcinated, so that the sliding surface of the slide member 4 is formed into an uneven surface.

Figure 3:
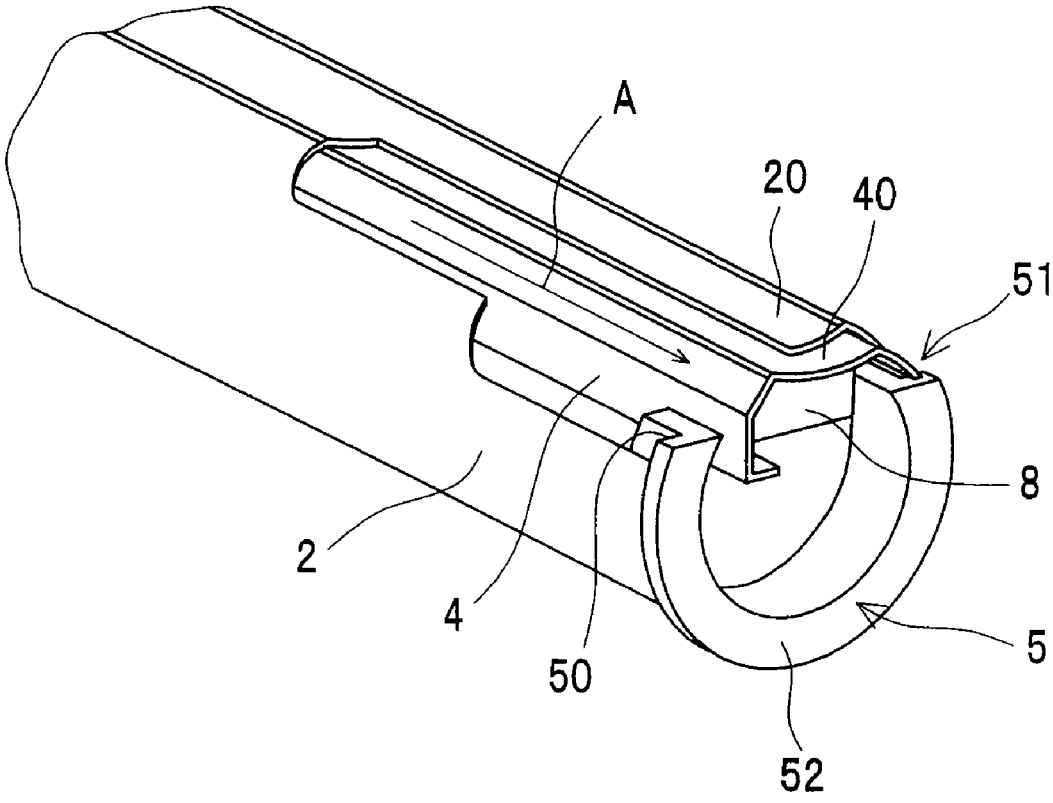
FIG. 3 shows a partially broken perspective view of a unit located on a pressurizing belt side.
Figure 4A:
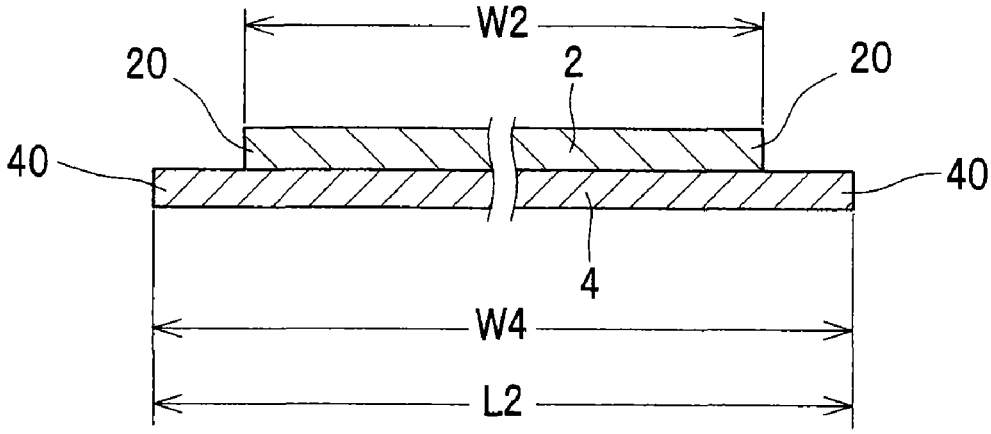
FIGS. 4A and 4B each show a cross-sectional view of the unit located on the pressurizing belt side.
Figure 4B:
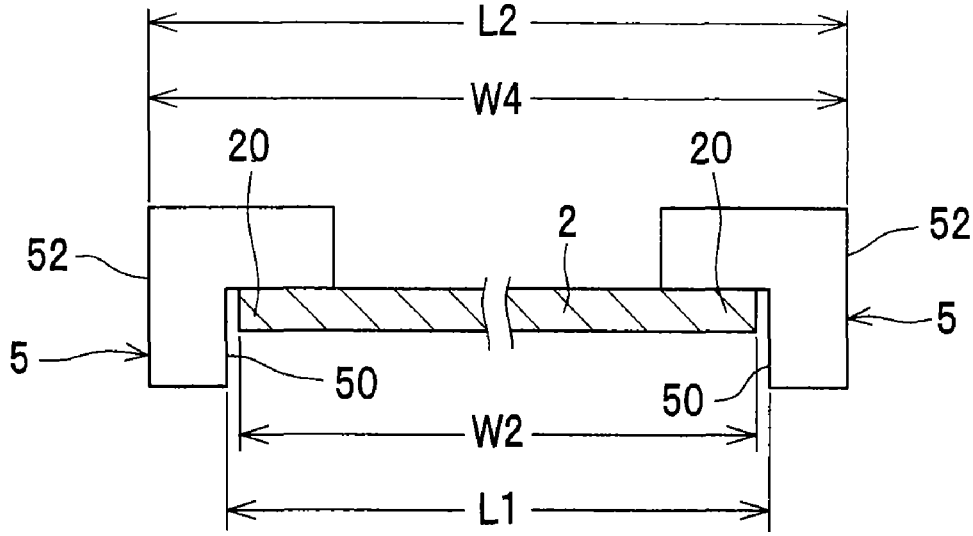

As shown in FIGS. 3, 4A and 4B, a width W4 of the slide member 4 is larger than a width W2 of the pressurizing belt 2, wherein these widths are defined as lengths in a direction parallel to the axial direction of the pressurizing belt 2. Thus, both the end sections 40 of the slide member 4 are positioned on the outsides of both the end sections 20 of the pressurizing belt 2 in the width direction parallel to the axis direction of the pressurizing belt 2.

The support member 5 has a regulating surface 50, which surface is positioned outside of the end section 20 of the pressurizing belt 2 and contacts the end section 20 of the pressurizing belt 2 so as to regulate movement of the pressurizing belt 2 in the axis direction thereof. In other words, the width W2 of the pressurizing belt 2 is slightly smaller than a distance L1 between a pair of the regulating surfaces 50 of the support members 5.

The width W4 of the slide member 4 is larger than the distance L1 between the regulating surfaces 50 of the support members 5. The support member 5 has a cut section 51 formed to prevent interfering with the end section 40 of the slide member 4. The cut section 51 is at the opening of C-shape of the support member 5.

The width W4 of the slide member 4 is almost equal to a distance L2 between a pair of outside surfaces 52 of the support members 5. The end sections 40 of the slide member 4 are free from interference with other members. Herein, FIG. 4A is a cross-sectional view of both the pressurizing belt 2 and the slide member 4 in the region of the nip section. FIG. 4B is a cross-sectional view of the pressurizing belt 2 including the support members 5.

According to the fixing device, as stated above, the width W4 of the slide member 4 is larger than the width W2 of the pressurizing belt 2, and both the end sections 40 of the slide member 4 are positioned outside of the end sections 20 of the pressurizing belt 2. Thus, the lubricant will not reach the end section 40 of the slide member 4 and therefore will not come around the inner side (backside) of the slide member 4, even when the lubricant between the slide member 4 and the pressurizing belt 2 moves in the direction along the axial direction of the pressurizing belt 2, as shown by arrow "A" in FIG. 3, on the upstream side with respect to the rotation direction of the pressurizing belt 2 (i.e., at an inlet N1 of the contact section shown in FIG. 1).

Therefore, the lubricant does not come into contact with the pressing member 3 located beneath the slide member 4. This prevents swelling of the pressing member 3 caused by the lubricant, and therefore prevents generation of wrinkles on the recording material P held between the heating roller 1 and the pressurizing belt 2.

The pressing member 3 is less likely to swell even when the lubricant comes into contact with the pressing member 3 because the viscosity of the lubricant is 200 cs or more. This prevents generation of the wrinkles on the recording material P. On the other hand, it is possible to suppress significant decrease in torque of the pressurizing belt 2 because the viscosity of the lubricant is 400 cs or less.

If the viscosity of the lubricant is smaller than 200 cs, the pressing member 3 tends to swell when the lubricant comes into contact with the pressing member 3, so that wrinkles tend to be generated on the recording material P. The larger viscosity of lubricant is better so as to suppress swelling of the pressing member 3 and to prevent generation of the wrinkles on the recording material P. However, if the viscosity of lubricant is larger than 400 cs, the torque of the pressurizing belt 2 is unfavorably increased. Accordingly, the upper limit of 400 cs is set for the viscosity of the lubricant.

Table 1 below shows relation between silicone oil viscosity (lubricant viscosity) and a generation state of paper wrinkles (wrinkles on recording material).

TABLE 1

| Oil viscosity (cs) | 50 | 100 | 200 | 300 | 400 | 1000 |
|---|---|---|---|---|---|---|
| Paper wrinkles | x | x | Δ | ○ | ○ | ○ |

In Table 1, the symbol "x" denotes presence of paper wrinkle problem. The symbol "Δ" denotes no paper wrinkle problem. The symbol "○" denotes absolutely no paper wrinkle problem. As shown in Table 1, the problem of paper wrinkle does not arise when the silicone oil viscosity is 200 cs or more.

The width W4 of the slide member 4 is larger than the distance L1 between the regulating surfaces 50 of the support members 5, as stated above. Therefore, even when the pressurizing belt 2 meanders in the axis direction, meandering of the pressurizing belt 2 is regulated by the regulating surface 50 of the support member 5. This makes it possible to maintain the state where both the end sections 40 of the slide member 4 are positioned outside of both the end sections 20 of the pressurizing belt 2.

The support member 5 has the cut section 51 formed to prevent interfering with the slide member 4, as stated above, so that the width W4 of the slide member 4 can be simply made larger than the distance L1 between the regulating surfaces 50 of the support members 5.

Second Embodiment

Figure 5:
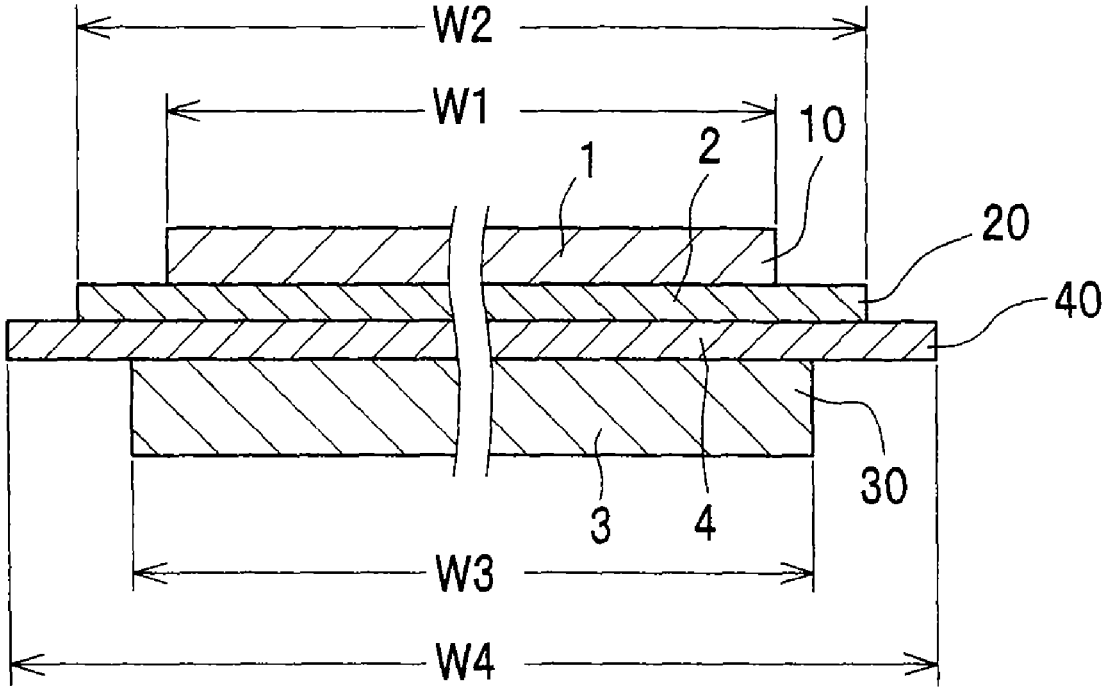
FIG. 5 shows a simplified schematic view of a fixing device according to a second embodiment.

A fixing device according to a second embodiment is shown in FIG. 5. The second embodiment is different from the first embodiment in the point that the widths of the pressing member and the heating roller are considered in addition to the widths of the slide member and the pressurizing belt. Others than the above are identical to those in the first embodiment, and therefore the description thereof is omitted.

Specifically, in the second embodiment, as shown in FIG. 5, the width W4 of the slide member 4 is larger than the width W2 of the pressurizing belt 2, the width W2 of the pressurizing belt 2 is larger than the width W3 of the pressing member 3, and the width W3 of the pressing member 3 is larger than the width W1 of the heating roller 1.

In other words, both the end sections 40 of the slide member 4 are positioned outside of both the end sections 20 of the pressurizing belt 2. Both the end sections 20 of the pressurizing belt 2 are positioned outside of both the end sections 30 of the pressing member 3. Both the end sections 30 of the pressing member 3 are positioned outside of both the end sections 10 of the heating roller 1.

This makes it possible to obtain sufficient pressure in the nip section formed by the contact between the heating roller 1 and the pressurizing belt 2, and simultaneously to certainly prevent swelling of the pressing member 3.

Third Embodiment

Figure 6:
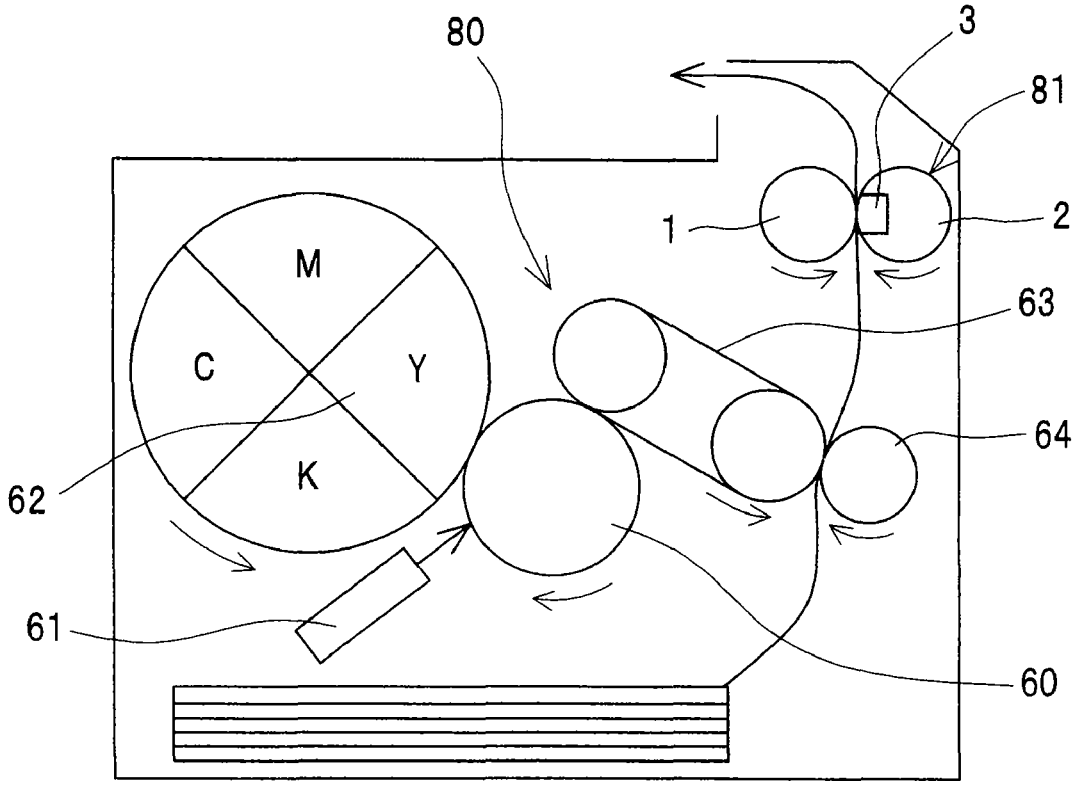
FIG. 6 shows a simplified schematic view of an image forming apparatus according to the present invention.
Figure 7:
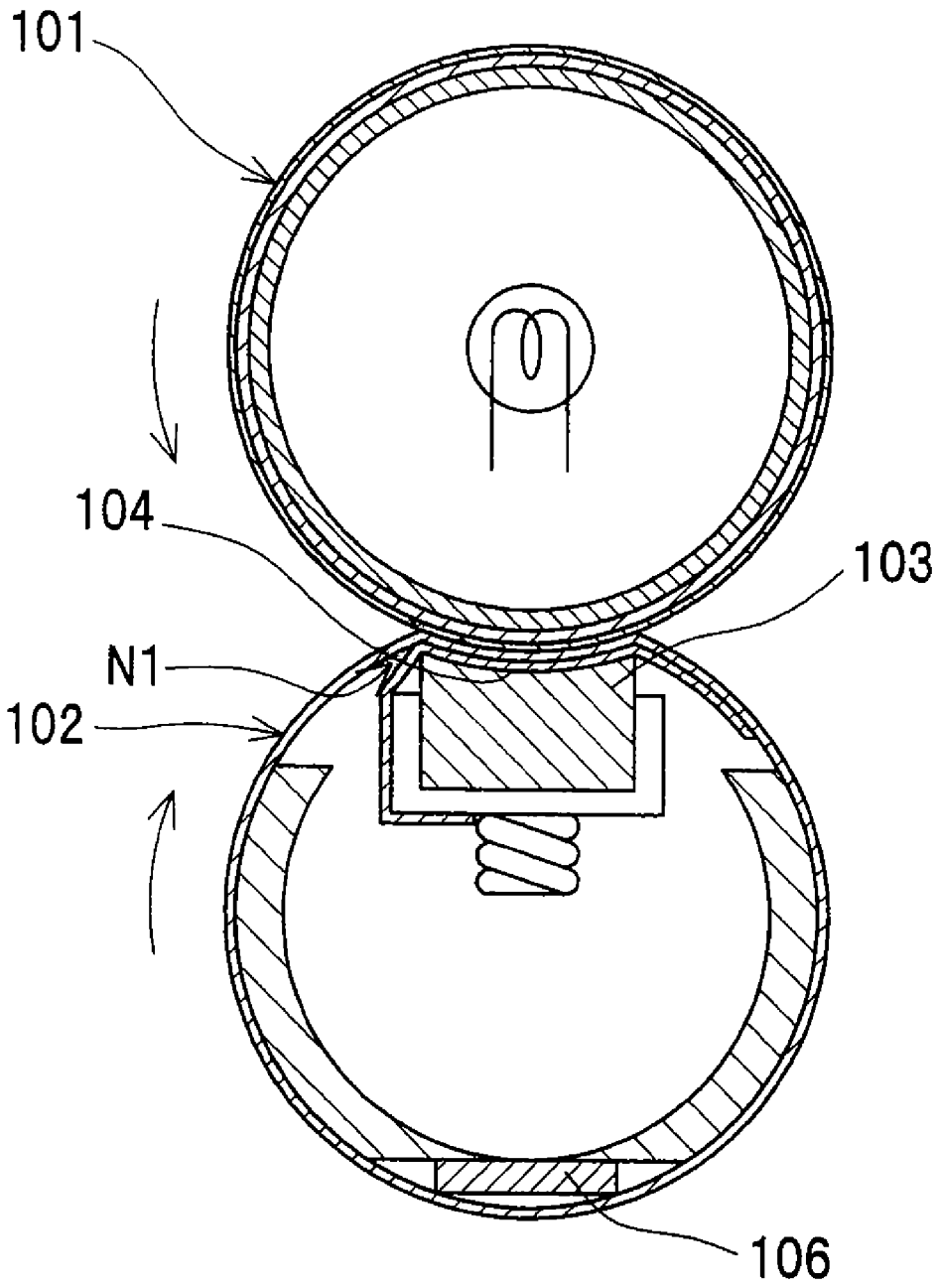
Fig.7 PRIOR ART
FIG. 7 shows a simplified schematic view of a conventional fixing device.
Figure 8:
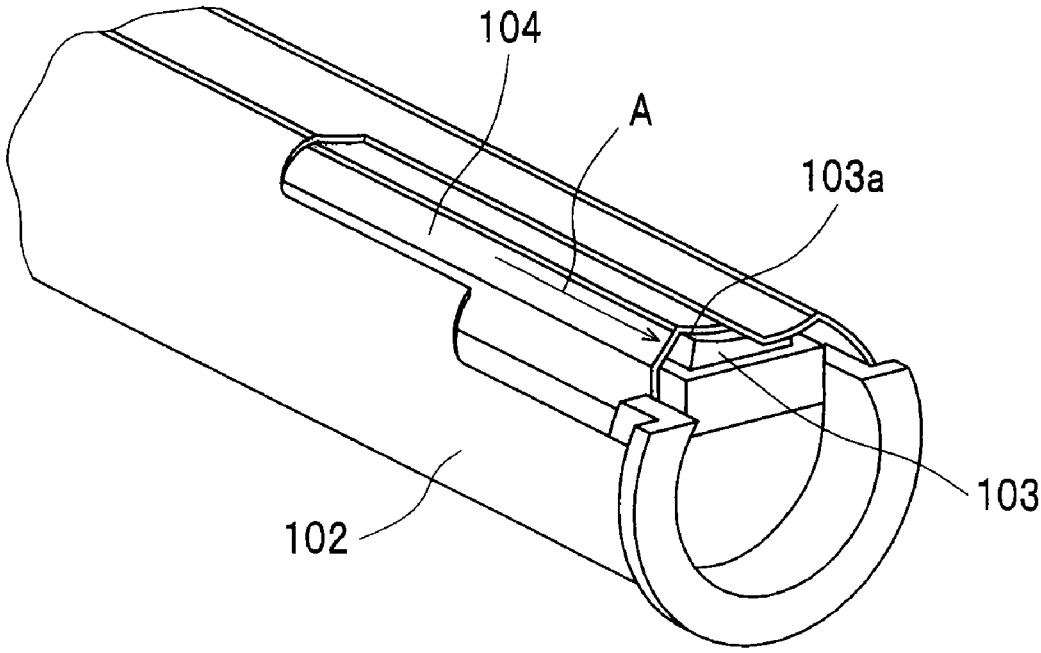
Fig.8 PRIOR ART
FIG. 8 shows a partially broken perspective view of a conventional unit located on the pressurizing belt side.

An image forming apparatus in a third embodiment is shown in FIG. 6. This image forming apparatus is composed of an imaging device 80 for adhering unfixed toner to recording materials to form images, and a fixing device 81 for melting the toner and fixing it to the recording materials.

For the fixing device 81, the fixing device in the first embodiment or the second embodiment is used.

The imaging device 80 is composed of a photoconductor 60, an intermediate transfer belt 63 and a secondary transfer roller 64. The photoconductor 60 forms a toner image. The toner image formed by the photoconductor 60 is transferred onto the intermediate transfer belt 63. The secondary transfer roller 64 transfers the image, which has been transferred onto the intermediate transfer belt 63, onto the recording material P.

The photoconductor 60 is uniformly charged by an unshown charging section. On the charged photoconductor 60, an electrostatic latent image is formed by an exposure section 61 which performs image exposure. The electrostatic latent image is developed by a developing section 62 which has toner of four colors: yellow (Y); magenta (M); cyan (C); and black (K).

Next, the function of the image forming apparatus is described.

On the photoconductor 60, a constant surface electric potential is formed by an unshown charging section. The surface of the photoconductor 60 in this state is irradiated with a laser beam corresponding to an image pattern to print by the exposure section 61. Thereby, the surface electric potential of an irradiated portion is attenuated, so that an electrostatic image is formed on the photoconductor 60.

In the developing section 62, toner is already in a charged state. The toner adheres to the photoconductor 60 by electrostatic suction force between the toner and the surface of the photoconductor 60 in response to the electrostatic image on the photoconductor 60.

The toner adhered to the surface of the photoconductor 60 is transferred onto the intermediate transfer belt 63 by an electric field formed between the photoconductor 60 and the intermediate transfer belt 63.

The above-stated process is repeated for every four colors. Thereby, an image is formed on the intermediate transfer belt 63 with the toner of the four colors overlapped.

Then, the toner image formed on the intermediate transfer belt 63 is transferred onto the recording material P by the secondary transfer roller 64 with use of an electric field and pressure. Finally, the toner image is fixed to the recording material P with heat and pressure in the fixing device 81.

The image forming apparatus is provided with the fixing device 81 stated in the first or second embodiment. Therefore, the image forming apparatus stably supplies excellent quality images for a long time.

The present invention shall not be limited to the embodiments stated above. For example, the heating roller 1 may be replaced with an endless belt. The image forming apparatus may be any apparatus including monochrome/collar copying machines, printers, facsimiles, and multi-functional machines.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. A fixing device, comprising:

a pair of rotation units rotating together in contact with each other;

an elastic pressing member placed inside of one rotation unit out of the pair of rotation units and pressing an inner surface of the one rotation unit toward other rotation unit out of the pair of rotation units;

a flexible slide member placed between the one rotation unit and the pressing member and sliding on the inner surface of the one rotation unit in rotation; and a lubricant feed section feeding a lubricant to the inner surface of the one rotation unit, wherein the one rotation unit is an endless belt, a width of the slide member is larger than a width of the one rotation unit in a direction parallel to an axis of the one rotation unit, and both end sections of the slide member are positioned outside of both end sections of the one rotation unit in the direction parallel to the axis of the one rotation unit.

2. The fixing device set forth in claim 1, wherein viscosity of the lubricant is 200 centistokes or more and 400 centistokes or less.

3. The fixing device set forth in claim 1, further comprising:

a pair of support members respectively attached to both the end sections of the one rotation unit in the direction parallel to the axis of the one rotation unit for supporting the one rotation unit, wherein the pair of support members respectively have regulating surfaces positioned outside of both the end sections of the one rotation unit, the regulating surfaces contacting with the end sections of the one rotation unit to regulate movement of the one rotation unit in the direction parallel to the axis of the one rotation unit, and a width of the slide member is larger than a distance between the regulating surfaces of the pair of support members in the direction parallel to the axis of the one rotation unit.

4. The fixing device set forth in claim 3, wherein each of the pair of support members has a cut section formed so as not to interfere with the slide member.

5. The fixing device set forth in claim 1, wherein the width of the slide member is larger than the width of the one rotation unit, the width of the one rotation unit is larger than a width of the pressing member, and the width of the pressing member is larger than a width of the other rotation unit in the direction parallel to the axis of the one rotation unit.

6. An image forming apparatus including a fixing device comprising:

a pair of rotation units rotating together in contact with each other;

an elastic pressing member placed inside of one rotation unit out of the pair of rotation units and pressing an inner surface of the one rotation unit toward other rotation unit out of the pair of rotation units;

a flexible slide member placed between the one rotation unit and the pressing member and sliding on the inner surface of the one rotation unit in rotation; and a lubricant feed section feeding a lubricant to the inner surface of the one rotation unit, wherein the one rotation unit is an endless belt, a width of the slide member is larger than a width of the one rotation unit in a direction parallel to an axis of the one rotation unit, and both end sections of the slide member are positioned outside of both end sections of the one rotation unit in the direction parallel to the axis of the one rotation unit.

7. The image forming apparatus set forth in claim 6, wherein viscosity of the lubricant is 200 centistokes or more and 400 centistokes or less.

8. The image forming apparatus set forth in claim 6, the fixing device further comprising:

a pair of support members respectively attached to both the end sections of the one rotation unit in the direction parallel to the axis of the one rotation unit for supporting the one rotation unit, wherein the pair of support members respectively have regulating surfaces positioned outside of both the end sections of the one rotation unit, the regulating surfaces contacting with the end sections of the one rotation unit to regulate movement of the one rotation unit in the direction parallel to the axis of the one rotation unit, and a width of the slide member is larger than a distance between the regulating surfaces of the pair of support members in the direction parallel to the axis of the one rotation unit.

9. The image forming apparatus set forth in claim 8, wherein each of the pair of support members has a cut section formed so as not to interfere with the slide member.

10. The image forming apparatus set forth in claim 6, wherein the width of the slide member is larger than the width of the one rotation unit, the width of the one rotation unit is larger than a width of the pressing member, and the width of the pressing member is larger than a width of the other rotation unit in the direction parallel to the axis of the one rotation unit.

* * * * *